United States Patent [19]

Fukushima

[11] Patent Number: 4,496,813

[45] Date of Patent: Jan. 29, 1985

[54] ILLUMINATION TYPE PUSH BUTTON SWITCH

[75] Inventor: Toshitsugi Fukushima, Tokyo, Japan

[73] Assignee: Sun Dengyosha Company, Limited, Tokyo, Japan

[21] Appl. No.: 491,535

[22] Filed: May 4, 1983

[30] Foreign Application Priority Data

Nov. 18, 1982 [JP] Japan ..... 57-201128

[51] Int. Cl.[3] ..... H01H 9/16

[52] U.S. Cl. ..... 200/314; 200/292

[58] Field of Search ..... 200/314, 317, 310, 311, 200/312, 313, 315, 316, 292, 67 D, 67 DA; 174/68.5

[56] References Cited

U.S. PATENT DOCUMENTS

| | | | |
|---|---|---|---|
| 4,075,442 | 2/1978 | Fukuda et al. | 200/295 X |
| 4,080,523 | 3/1978 | de Loisy | 200/314 |
| 4,268,735 | 5/1981 | Iwakiri | 200/314 |
| 4,302,647 | 11/1981 | Kandler | 200/314 X |
| 4,354,079 | 10/1982 | Yoshimura | 200/314 |

FOREIGN PATENT DOCUMENTS 1065392 10/1979 Canada ..... 200/314

OTHER PUBLICATIONS

*Western Electric Tech. Dig.*, No. 53, Jan. 1979, "*Pushbutton Switch*", Spahn.

*IBM* Technical Disclosure Bulletin, vol. 10, No. 8, Jan. 1968.

*Primary Examiner*—Stephen Marcus

*Assistant Examiner*—Ernest Cusick

*Attorney, Agent, or Firm*—Wenderoth, Lind & Ponack

[57] ABSTRACT

An illumination type push button switch wherein a switch mechanism and an illuminant such as a light emitting diode are provided interiorly of a casing, a pair of external terminals adapted to supply power to the illuminant to light the same are supported on a base plate detatchably supported on said casing. An electronic circuit is formed on the base plate so that the circuit may be interposed in the electric connection between the illuminant and the external terminals, thereby rendering miniaturization of the switch possible and facilitating handling of the same.

4 Claims, 5 Drawing Figures

ILLUMINATION TYPE PUSH BUTTON SWITCH

BACKGROUND OF THE INVENTION

The present invention relates to an illumination type push button switch which employs an illuminant such as a light emitting diode, a lamp or the like. It is conventional in the illumination type push button switch that electric power for lighting the illuminant is supplied from a pair of external terminals electrically connected to the illuminant. Where a light emitting diode is used as an illuminant, a protective resistor is required. However, in a conventional illumination type push button switch, there is a drawback that if the protective resistor is encased in the switch, the switch cannot be miniaturized. Furthermore, in a known illumination type push button switch which does not encase a protective resistor therein, there is also a drawback in that the protective resistor must be provided externally, resulting in an inconvenience in handling. Under these circumstances, it has been heretofore desired to develop an illumination type push button switch which overcomes the drawbacks noted above with respect to the prior art and which is small in size and easy to handle.

SUMMARY OF THE INVENTION

It is therefore an object of the present invention to provide an illumination type push button switch which uses an illuminant such as a light emitting diode, a lamp or the like and which is small in size and easy to handle. To achieve the aforesaid object, the present invention provides an illumination type push button switch characterized in that there is provided an illuminant disposed together with a switch mechanism within a casing of said push button switch, a pair of external terminals for receiving a supply of electric energy from a power source externally of the switch is electrically connected to said illuminant within the casing to light the illuminant, said pair of external terminals being supported on a base plate which is a good insulator, detachably supported on a lower portion of the casing, and an electronic circuit formed on said base plate is interposed in the electric connection between said pair of external terminals and said illuminant.

DETAILED DESCRIPTION OF THE INVENTION

Figure 1:
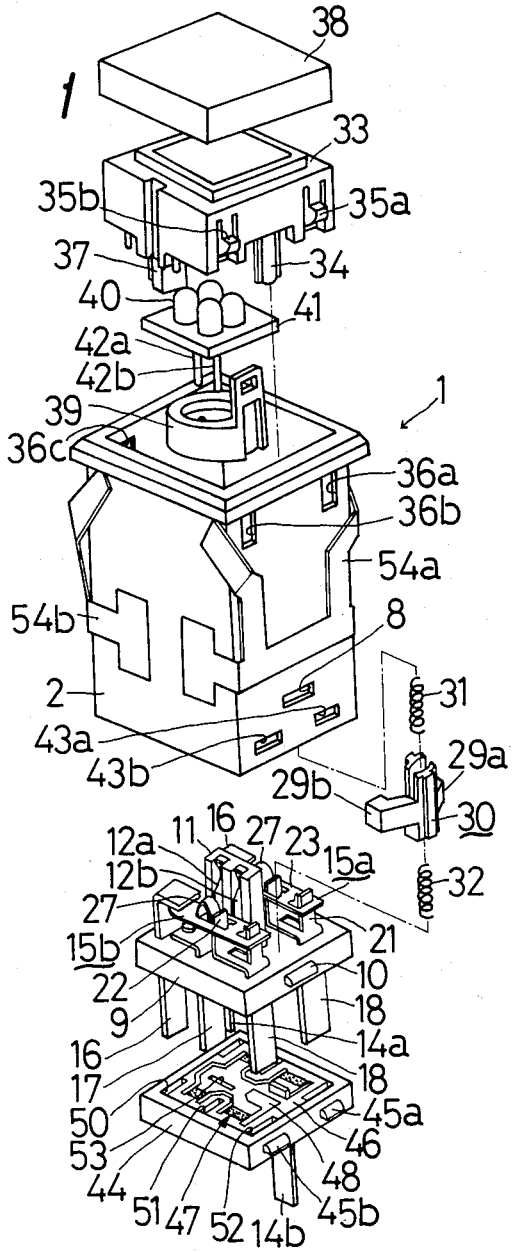
FIG. 1 is an exploded perspective view of the whole structure showing one embodiment of the present invention.
Figure 4:
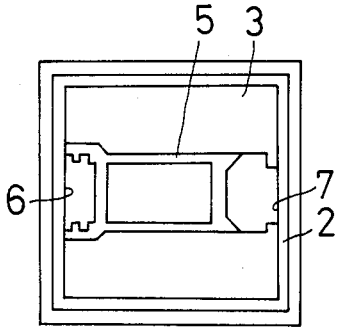
FIG. 4 is a bottom view of a casing.
Figure 2:
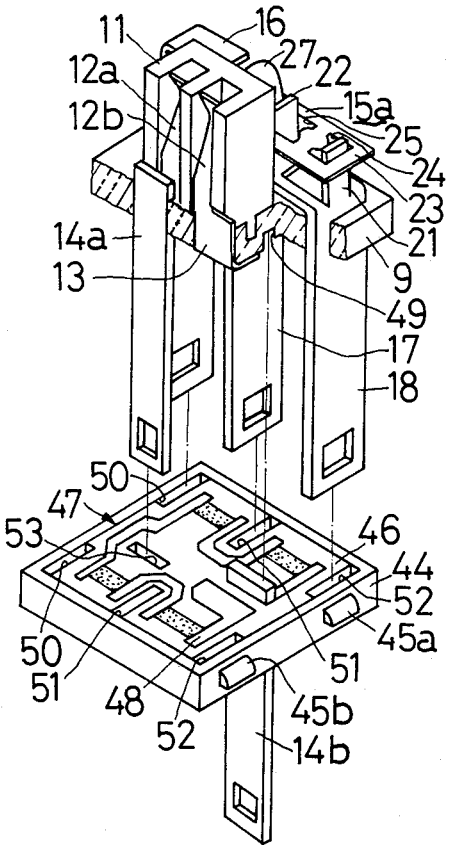
FIG. 2 is an exploded enlarged perspective view of a principal portion of the structure shown in FIG. 1, cut away.
Figure 3:
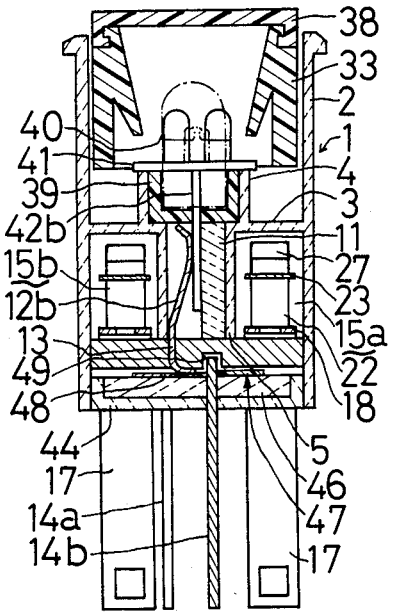
FIG. 3 is a longitudinal sectional view of the whole structure including a light emitting diode.

As can be seen clearly from FIGS. 1 and 4, a casing 2 of an illumination type push button switch 1 is formed of a material such as plastic into a square tube configuration. As shown in FIG. 3, the casing 2 is internally integrally provided with a supporting plate 3 nearly in the vertical middle thereof, said supporting plate 3 being divided into two parts by means of a generally rectangular cut. The supporting plate 3 has upper and lower surfaces from which are suspended an upper supporting element 4 and a lower supporting element 5, respectively. Also, as can be seen from FIG. 4, cut portions adjacent to the lower supporting element 5 of the supporting plate 3 are formed with receiving holes 6 and 7, respectively. The casing 2 has a pair of opposed sides whose lower portions have bored therethrough respective through-holes 8 (only one of which is shown) so as to oppose each other as shown in FIG. 1, and a bottom plate 9 formed of an insulating material is fitted into said through-holes by projections 10 (only one of which is shown) which respectively project from said pair of opposed sides. On the bottom plate 9 is suspended a supporting body 11 whose horizontal cross section is in the shape of an E formed of an insulating material so that the supporting body 11 may be positioned within the lower supporting element 5. The supporting body 11 has two recesses in which keep pieces **12*a* and 12*b* formed from metal leaf springs are arranged, said keep pieces 12*a* and 12*b* each having a curved upper portion placed in resiliently contact with said supporting body 11. As can be seen clearly from FIG. 2, an upper end of a conductive plate 13 having a good electric conductivity which extends through and is secured to the bottom plate 9 is connected to the lower end of the keep piece 12*b*, said conductive plate 13 having its lower end bended so that the former may be placed in close contact with the lower surface of the bottom plate 9. An upper end of an external terminal 14*a* which extends through and is secured to the bottom plate 9 is connected to the lower end of the keep piece 12*a***.

Two micro-switches **15*a* and 15*b* are arranged on the bottom plate 9 so that the supporting body 11 is put therebetween. Since these micro-switches 15*a* and 15*b* have the same structure, only the micro-switch 15*a* will be described with reference to FIGS. 1, 2 and 5. A normally open terminal 16, a normally closed terminal 17 and a common terminal 18 vertically extend through and are secured to the bottom plate 9, and upper ends of the normally open terminal 16 and the normally closed terminal 17 are bent so as to have opposing surfaces, the opposing surfaces thereof being provided with a normally open contact 19 and a normally closed contact 20, respectively. On the other hand, the upper portion of the common terminal 18 is formed with a rising portion 22 which is bent in a direction toward normally closed terminal 17 in slightly spaced relation with the upper surface of the bottom plate 9 (except a vertical portion 21) and has a topmost end which extends vertically with respect to the bottom plate 9. A conductive plate 23 having good electric conductivity is fitted in and supported in a groove (not shown), which is provided so as to extend widthwise of the vertical portion 21, in a manner such that the conductive plate 23 can rise and fall at the trailing end of a through-hole 24 thereof. The conductive plate 23 extends horizontally so that the rising portion 22 of the common terminal 18 may be positioned within the front through-hole 25, and has a front end to which two switching contacts 26*a* and 26*b* are secured so that they may come into contact with the normally open contact 19 and the normally closed contact 20, respectively. A front end of an elastic piece 27 having good electric conductivity comes into resilient contact with the front edge of the front through-hole 25 of the conductive plate 23. The elastic piece 27 is fitted in and supported in a groove (not shown) so that it can rise or fall, is curved upwardly, and has its rear end bent generally horizontally and extending widthwise of the rising portion 22 of the common terminal 18**.

Figure 5:
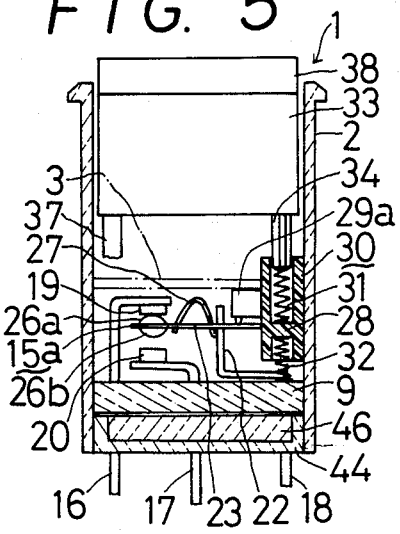
FIG. 5 is a longitudinal partly sectional view showing a switch mechanism.

As shown in FIGS. 1 and 5, a partitioning wall 28 is mounted internally of the receiving hole 7 of the supporting plate 3 and an elevating body 30 with a pair of operating arms 29*a* and 29*b* which project laterally, is received and supported therein so as to be movable up and down. Foremost ends of the operating arms 29*a* and 29*b* respectively come into contact with upper surfaces of the conductive plates 23 of the micro-switches 15*a* and 15*b*. Coiled springs 31 and 32 are inserted into and arranged above and below the partitioning wall 28 within the elevating body 30, said coiled spring 32 having its lower end bearing on the bottom plate 9. A lower end of a projection 34 provided on a push piece 33 bears on the upper end of the coiled spring 31. This push piece 33 is supported movably up and down on the casing 2 by an arrangement wherein guide pawls 35*a* and 35*b* (only one side is shown) provided on a pair of opposed sides of the push piece 33 are inserted into elongated holes 36*a*, 36*b* and 36*c* (one of which is not shown) bored in a pair of opposed sides of the casing 2. Accordingly, when the push piece 33 moves down, the coiled springs 31 and 32 are compressed by the projection 34 with the result that the elevating body 30 moves down, and the conductive plates 23 are forcibly moved by the operating arms 29*a* and 29*b* whereby the micro-switches 15*a* and 15*b* are switched and actuated. Reference numeral 37 designates an action plate provided on the push piece 33 and used for the alternate (upward) action, the action plate extending through the receiving hole 6 of the supporting plate 3. Reference numeral 38 denotes a style strip capped over the push piece 33.

As shown in FIGS. 1 and 3, connection terminals 42*a* and 42*b*, which are provided on an LED base plate 41 having four light emitting diodes 40 secured thereto to supply power to the LEDs 40, are inserted into and supported on a socket 39 inserted into the upper supporting element 4. Thereby, the LED base plate 41 is positioned so that the connection terminals 42*a* and 42*b* extend into the recess of the supporting body 11 and resiliently bear on the push pieces 12*a* and 12*b*. It is noted that if a lamp is employed as an illuminant, the socket 39 serves, instead of receiving the connection terminals 42*a* and 42*b* of the LEDs 40, as a socket for receiving terminals of the lamp as indicated by the phantom outline in FIG. 3.

As is apparent from FIG. 1, two pairs of through-holes 43*a* and 43*b* (which are shown only in one side) are bored opposedly each other in the lower ends of a pair of opposed sides of the casing 2, and a bottom cover 44 formed of an insulating material is snapped and supported therein by projections 45*a* and 45*b* (which are shown only on one side) projecting from a pair of opposed sides. As shown in FIGS. 1 to 3, the bottom cover 44 has a base plate 46 formed of an insulating material such as ceramic mounted thereon, and projective resistors, various elements and wirings are baked or photographically printed on the base plate 46 to form an integrated electronic circuit 47. The electronic circuit 47 has one end connected to a connection plate 48 formed from a copper plate or the like having good electric conductivity, and has the other end connected the external terminal 14*b* which extends through the base plate 46 and the bottom cover 44 and is secured to the base plate 46. As shown clearly in FIG. 3, under the condition that the base plate 46 together with the bottom cover 44 are mounted on the casing 2, the connection plate 48 comes into contact with the conductive plate 13 and the upper end of the external terminal 14*b* is positioned within the recess 49 formed in the bottom plate 9. The base plate 46 and the bottom cover 44 have through-holes 50, 51 and 52 for respectively receiving the terminals 16, 17 and 18 of the micro-switches 15*a* and 15*b* and a through-hole 53 for receiving the external terminal 14*a*. In FIG. 1, reference numerals 54*a* and 54*b* designate fixing members formed from metal plates, which are mounted on the casing 2 to secure the illumination type push button switch 1 to a mounting plate (not shown).

In the above-described embodiment, when the illumination type push button switch 1 is assembled as shown FIGS. 3 and 5, a circuit is formed which comprises a series of elements arranged in the order external terminal 14*b*—electronic circuit 47—connection plate 48—conductive plate 13—push piece 12*b*—connection terminal 42*b*—LED 40—connection terminal 42*a*—push piece 12*a*—external terminal 14*a*, whereby a power source may be supplied to light the LED 40. On the other hand, when the style strip 38 is forcibly moved downwardly, this force is successively transmitted to the push piece 33, projection 34, coiled spring 31 and elevating body 30, and the micro-switches 15*a* and 15*b* are switched and actuated by the pressing force of the operating arms 29*a* and 29*b*. An amount of displacement of downward movement of the style strip 38 and push piece 33 is normally about 3 mm but an amount of displacement of downward movement of the action arms 29*a* and 29*b* acting on the conductive plate 23 of the micro-switches 15*a* and 15*b* is 1 to 2 mm due to the contraction of the coiled springs 31 and 32.

If an arrangement is made as described above wherein the pressing force of the push piece 33 is transmitted to the conductive plate 23 of the micro-switches 15*a* and 15*b* by the coiled springs 31 and 32 without using an actuator, the mechanism within the casing 2 can be simplified to render effective utilization of a narrow internal space possible, whereby the illumination type push button switch 1 can be further miniaturized.

While in the above-described embodiment, the case has been described in which the LED 40 is employed as an illuminant, it should be understood that in the present invention, a lamp can be employed. Moreover, if a hybrid IC or the like is incorporated into the electronic circuit 47, the switch can be connected to an AC power supply.

As will be apparent from the foregoing description, the present invention has the excellent effects that by encasing a base plate formed with an electronic circuit into an illumination type push button switch, it becomes possible to miniaturize said switch, and that if a power source need be changed, only the base plate need be exchanged, and therefore, handling of the switch is extremely easy.

What is claimed is:

1. An illumination type push button switch comprising;

a casing;

a light emitting diode having connection terminals, inside said casing;

a planar base plate detachably supported in a said casing;

an integrated electronic circuit including at least one light emitting diode protective resistor formed in a plane on said base plate;

a pair of external terminals on said base plate; and means, mounted in said casing, for electrically connecting said light emitting diode to an electric power source through said external terminals and said integrated electronic circuit with said integrated electronic circuit interposed between said external terminals and said light emitting diode, one of said pair of external terminals being electrically connected to said integrated electronic circuit, said connecting means including a first electrically conductive terminal keep member connected to one of said connection terminals an electrically conductive connection plate connected at one end to said integrated electronic circuit, extending away from said base plate into contact with said fuel electrically conductive terminal keep member and a second electrically conductive terminal keep member connected at one end to the other of said pair of external terminals and at the other end to another one of said connection terminals.

2. An illumination type push button switch as in claim 1, wherein said conductive connection plate is formed in a plane on said base plate, said connecting means further comprising a bent electrically conductive plate having a first planar portion in flush contact with an upper surface of said connection plate and a second portion connecting said first portion to said one end of said first electrically conductive member.

3. An illumination type push button switch as in claim 2, further comprising a horizontal bottom plate mounted in said casing and a supporting body mounted in said casing on said bottom plate having a base and three legs extending from said base so as to define a generally E-shaped horizontal cross section, said first and second terminal keep members being mounted between said legs so as to extend vertically therein, said bent plate being mounted to an edge of said bottom plate.

4. An illumination type push button switch as in claim 3, wherein said first and second terminal keep members comprise leaf springs.

* * * * *